United States Patent [19]

Patterson

[11] Patent Number: 4,884,805

[45] Date of Patent: Dec. 5, 1989

[54] TURF REPAIR APPARATUS

[76] Inventor: James V. Patterson, 2958 SE. Delmar St., Port Salerno, Fla. 34992

[21] Appl. No.: 262,886

[22] Filed: Oct. 26, 1988

Related U.S. Application Data

[63] Continuation-in-part of Ser. No. 84,758, Aug. 13, 1987, abandoned, which is a continuation-in-part of Ser. No. 876,733, Aug. 7, 1986, abandoned.

[51] Int. Cl.[4] ..... A63B 57/00; A01B 1/18

[52] U.S. Cl. ..... 273/32 B; 172/378

[58] Field of Search ..... 172/378, 379, 380; 273/32 B, 32 A, 32 R; 294/50.6, 50.7, 61, 19.2

[56] References Cited

U.S. PATENT DOCUMENTS

| | | | |
|---|---|---|---|
| 2,642,306 | 6/1953 | Beeler | 294/61 |
| 2,732,242 | 1/1956 | Belford | 294/61 |
| 3,539,017 | 11/1970 | Johnson | 273/32 B |
| 4,081,192 | 3/1978 | Jones | 296/61 |
| 4,627,621 | 12/1986 | Tate | 273/32 B |

*Primary Examiner*—George J. Marlo

*Attorney, Agent, or Firm*—Steele, Gould & Fried

[57] ABSTRACT

An apparatus for removing ball marks from golf course surfaces includes an elongated handle having at one end thereof a tongue having prongs to be inserted into the turf, adjacent and beneath the ball mark. A tension spring attaches the tongue to the handle, and a compression spring spaces the tongue from the handle against the action of the tension spring. The tension spring attachment permits the tongue to pivot relative to the long axis of the handle, and the compression spring acts to return the tongue to alignment with the long axis of the handle after each use.

9 Claims, 1 Drawing Sheet

TURF REPAIR APPARATUS

BACKGROUND OF THE INVENTION

Cross Reference to Related Application

This application is a continuation-in-part of application Ser. No. 084,758, filed Aug. 13, 1987, now abandoned, which is a continuation-in-part of application Ser. No. 6/876,733, filed Aug. 7, 1986, now abandoned.

FIELD OF THE INVENTION

This invention relates generally to golf accessories, and more particularly to turf repair devices for use on golf course surfaces.

DESCRIPTION OF THE PRIOR ART

Golf balls lofted into the air strike the golf course surface sharply when they land and create an indentation or ball mark. The ball marks damage the golf course surface. Ball marks in the putting green are especially troublesome, as they interfere with the roll of the golf ball across the green during putting. Golfers are expected, and in some cases are required by course rules, to lift the indentations from the golf course surface created by their golf balls.

Various tools have been proposed to remove the ball marks from golf course surfaces. These tools are manipulated by hand and require the user to stoop down to the ground. This repeated bending is tiring and particularly difficult for those golfers with bad backs or knees.

SUMMARY OF THE INVENTION

It is an object of the invention to provide a turf repair apparatus which will effectively remove ball marks from golf course surfaces.

It is another object of the invention to provide a turf repair apparatus which will not require the golfer to stoop repeatedly to manipulate the device.

These and other objects are accomplished by a turf repair apparatus which comprises an elongated handle and a tongue having prongs adapted to be driven into the ground to lift the ball mark. The tongue is secured to an end of the elongated handle by a tension spring which acts to draw the tongue toward the elongated handle. A compression spring spaces the tongue from the elongated handle against the action of the tension spring. The tension spring attachment permits the tongue to pivot relative to the long axis of the handle, and the compression spring acts to return the tongue to alignment with the long axis of the handle after each use.

The tension spring is preferably mounted in part within an open interior passage of the elongated handle and can be fixed in place by suitable fastening structure. A preferred fastening structure is a rivet which passes transversely through the elongated handle and which engages a looped end of the tension spring. A hooked portion at an opposite end of the tension spring can engage a suitable opening in a neck portion of the tongue.

The compression spring is preferably positioned over the end of the elongated handle and the tension spring, and abuts a stop on the handle which prevents further longitudinal movement onto the elongated handle. The stop can be formed by outwardly extending portions of the rivet. The opposite end of the compression spring can abut a suitable shoulder portion of the tongue. The compression spring is thereby held firmly between the stop and the tongue by the action of the tension spring.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
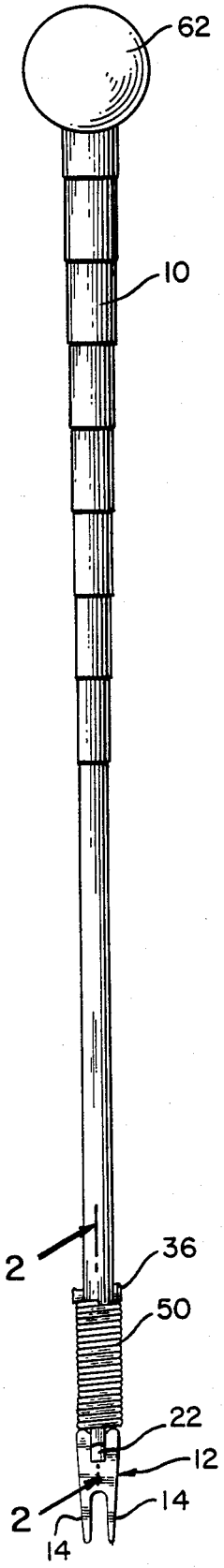
FIG. 1 is a side elevation of a turf repair apparatus according to the invention.
Figure 2:
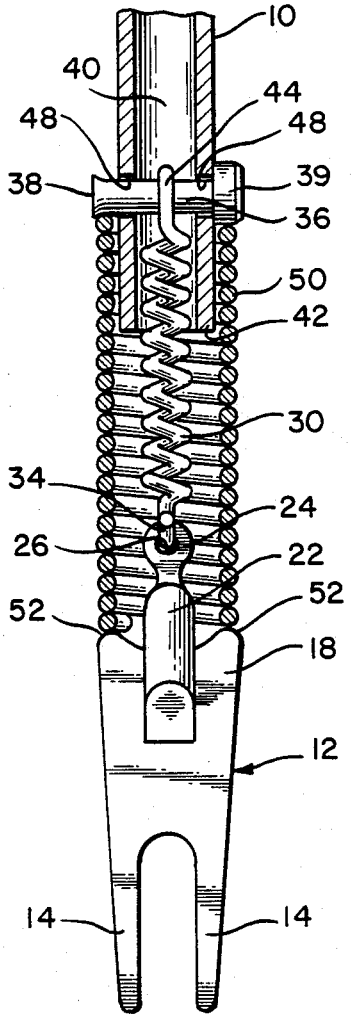
FIG. 2 is a cross-section taken along line 2—2 in FIG. 1.

A turf repair apparatus according to the invention is shown in FIGS. 1–2. The turf repair apparatus comprises an elongated handle 10 and a tongue 12. The tongue 12 has a lower portion with a pair of downwardly extending prongs 14 adapted to engage the earth beneath the ball mark and thereby to perform the requisite lifting action.

The tongue 12 has an upper portion 18 which can be provided with an attachment means for connecting the tongue 12 to the handle 10. The attachment means can be provided on a neck 22 of the upper portion 18. The attachment means can be an eyelet 24 with an aperture 26. The tongue 12 is engaged to the elongated handle 10 by a tension spring 30, and the tension spring 30 can have a hook portion 34 which is adapted to engage the aperture 26 of the eyelet 24.

The tension spring 30 is connected to the elongated handle 10 by suitable fastening means such as the rivet 36. The elongated handle 10 will preferably be hollow with an open interior passage 40. The rivet 36 can pass transversely through openings 48 in sides of the elongated handle 10 and can be secured in place between the flared end 38 and head 39, as is known in the art. The tension spring 30 preferably extends a distance into the open interior passage 40 beyond the lower extremity 42 of the elongated handle 10. A loop 44 of the tension spring 30 engages the rivet 36 to secure the tension spring 30 to the handle 10.

A compression spring 50 surrounds the tension spring 30, and preferably also a lower end portion of the elongated handle 10 and a portion of the neck 22 of the tongue 12. The compression spring 50 at one end abuts a stop on the elongated handle 10, which can be outwardly extending portions of the rivet 36. An opposite end of the compression spring 50 engages the tongue 12, as at shoulders 52. The compression spring extends the tension spring 30, and the action of the tension spring 30 draws the tongue 12 into the compression spring 50 to secure the compression spring 50 between the shoulders 52 of the tongue 12 and the rivet 36.

CONSTRUCTION

The device can be constructed from the component parts by first positioning the tension spring 30 within the interior passage 40 of the elongated handle 10. The loop 44 is aligned with the openings 48, and the rivet 36 is inserted through the openings 48 and secured in place by flaring the end 38. The loop 44 and tension spring 30 are thereby engaged within the elongated handle 10.

The compression spring 50 is then placed about the tension spring 30 and lower end 42 of the elongated handle 10, and abuts the outwardly extending flared end 38 and head 39 of the rivet 36. Narrow pliers or a similar grasping tool can be used to reach within the compression spring 50 to grasp the tension spring 30 and pull the hook portion 34 of the tension spring 30 beyond the opposite end of the compression spring 50. The hook 34 can then be engaged to the aperture 26 of the eyelet 4 of the tongue 12 to secure the assembly together. The compression spring will be pressed between the rivet 36 and the tongue 12 by the action of the tension spring 30 when the tension spring 30 is released by the grasping tool.

A suitable hand grasp 62 can be provided at an end of the elongated handle 10 opposite the tongue 12 to facilitate the manipulation of the apparatus. The hand grasp 62 can be fashioned in the overall shape of a golf ball to provide a pleasing aesthetic appearance.

OPERATION

Figure 3:
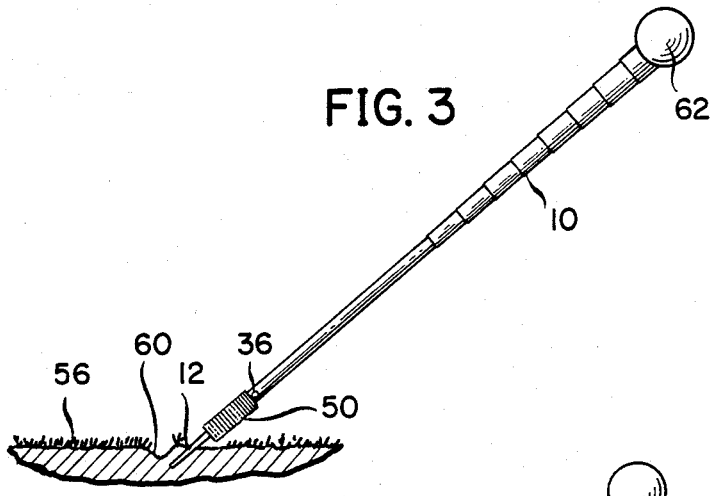
FIG. 3 is a side elevation, partially in section, depicting a first step for turf repair utilizing the invention.
Figure 4:
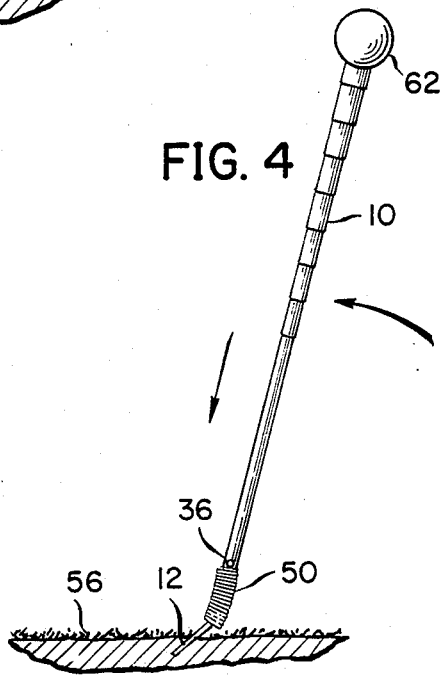
FIG. 4 is a side elevation, partially in section, showing a second step in turf repair utilizing the invention.

The operation of the turf repair apparatus of the invention is depicted in FIGS. 3–4. The elongated handle 10 is pressed downwardly (FIG. 3) to drive the prongs 14 of the tongue 12 into the turf 56 adjacent and beneath the ball mark 60. The golfer then presses downwardly on the elongated handle 10 (FIG. 4) while pivoting the handle, preferably forward. The tension spring 30 and compression spring 50 to bend to permit the tongue 12 to pivot relative to the handle 20. The tongue 12 and its prongs 14 are urged upwardly to lift the ball mark. The tongue 12 is then removed from the soil, and the compression spring 50 returns the tongue 12 to a position of substantially longitudinal alignment with the long axis of the handle 10. Thereafter, the area of turf which formerly included the ball mark is tapped down with a foot, golf club, or the apparatus itself to smooth the area of turf that has been lifted.

This invention can be embodied in other specific forms without departing from the spirit or essential attributes thereof, and accordingly, reference should be made to the following claims, rather than to the foregoing specification as indicating the scope of the invention.

I claim:

1. A tool for smoothing turf, comprising:

a tongue having a lower portion with prongs to be inserted into the turf, said tongue further comprising an upper portion having an attachment means;

an elongated handle for holding the tool, said handle having means of attachment at its lower end, and further comprising stop means;

a tension spring extending from said attachment means of said upper portion of said tongue to said attachment means of said handle; and, a compression spring surrounding said tension spring and abutting against said upper portion of said tongue at one end, and against said stop means of said handle at the other end.

2. The tool of claim 1, wherein said attachment means of said handle is a protrusion said tension spring further comprising loop means adapted to engage said protrusion.

3. The tool of claim 2, wherein said elongated handle has an open interior passage, said loop of said tension spring being positioned within said open interior passage, said protrusion comprising a rivet extending transversely through said open interior passage.

4. The tool of claim 3, wherein said stop means comprises portions of said rivet extending laterally outward from sides of said elongated handle.

5. The tool of claim 4, wherein said attachment means in said upper portion of said tongue comprises an aperture, said tension spring further comprising a hook portion substantially opposite side loop portion, said hook portion being adapted to engage said opening of said tongue.

6. The tool of claim 3, wherein said attachment means in said upper portion of said tongue comprises an aperture, said tension spring further comprising a hook portion substantially opposite said loop portion, said hook portion being adapted to engage said opening of said tongue.

7. The tool of claim 2, wherein said upper portion of said tongue comprises a neck portion adapted to be surrounded in part by said compression spring, said attachment means of said tongue being provided in said neck portion.

8. The tool of claim 1, further comprising grasping means at an end of said elongated handle opposite said tongue, said grasping means being adapted to facilitate downward pressure on said elongated handle.

9. The tool of claim 8, wherein said grasping means is fashioned to resemble a golf ball.

* * * * *